US006286234B1

(12) United States Patent
Smith, Jr.

(10) Patent No.: US 6,286,234 B1
(45) Date of Patent: Sep. 11, 2001

(54) FOOTWEAR PROTECTOR FOR MOTORCYCLE RIDING

(76) Inventor: Larry B. Smith, Jr., 661 N. Labarnum Ave. #3, Richmond, VA (US) 23223

( * ) Notice: Subject to any disclaimer, the term of this patent is extended or adjusted under 35 U.S.C. 154(b) by 0 days.

(21) Appl. No.: 09/574,080

(22) Filed: May 19, 2000

(51) Int. Cl.[7] ..... A43B 3/18

(52) U.S. Cl. ..... 36/131; 36/7.4; 36/72 R; 36/77 R

(58) Field of Search ..... 36/72 R, 7.4, 131, 36/7.7, 77 R

(56) References Cited

U.S. PATENT DOCUMENTS

| | | | |
|---|---|---|---|
| D. 378,470 | | 3/1997 | McDaniel . |
| 1,729,816 | * | 10/1929 | Binder . |
| 2,149,102 | * | 2/1939 | Quennard . |
| 2,436,187 | | 2/1948 | Bestland . |
| 2,552,700 | | 5/1951 | Watts . |
| 3,812,606 | | 5/1974 | Merola . |
| 4,780,970 | | 11/1988 | McArthur, Sr. et al. . |
| 4,991,318 | | 2/1991 | Cornell . |
| 5,234,230 | * | 8/1993 | Crane et al. . |
| 5,566,477 | * | 10/1996 | Mathis et al. . |
| 5,855,078 | * | 1/1999 | Starker . |
| 5,996,258 | * | 12/1999 | Simmons . |

FOREIGN PATENT DOCUMENTS

| | | | |
|---|---|---|---|
| 2652487 | * | 4/1991 | (FR) . |

* cited by examiner

*Primary Examiner*—Ted Kavanaugh

(57) ABSTRACT

A footwear protector for motorcycle riding for protecting the footwear of motorcycle riders with an article that is easily mounted on the footwear. The protective device includes a sheath member having a forward end and a rearward end, with the forward end being closed and the rearward end having an opening. The sheath member has a top wall and a bottom wall, with a pair of side walls and a front wall extending between the top and bottom walls. The device also includes a gear shift actuator cushion mounted on the top wall of the sheath member. The actuator cushion extends from the opening toward the forward end of the sheath member. A pocket is formed on the top wall of the sheath member. The actuator cushion comprises a resiliently compressible cushion in the pocket for cushioning the transmission of impacts from an upper surface of the actuator cushion to the top wall of the sheath member and footwear positioned in the sheath member. The side walls are preferably formed of a resiliently stretchable material, and the resiliently stretchable material may include spandex.

14 Claims, 3 Drawing Sheets

FOOTWEAR PROTECTOR FOR MOTORCYCLE RIDING

BACKGROUND OF THE INVENTION

1. Field of the Invention

The present invention relates to footwear protection devices and more particularly pertains to a new footwear protector for motorcycle riding for protecting the footwear of motorcycle riders with an article that is easily mounted on the footwear.

2. Description of the Prior Art

The use of footwear protection devices is known in the prior art. More specifically, footwear protection devices have been devised for use by riders of motorcycles, which typically have foot actuated gear shifting levers that are engaged by the top of the rider's foot. The gear shifting lever thus contacts the top surface of the upper of the footwear, which is much more vulnerable to damage by the lever than, for example, the sole of the footwear. Motorcycle riding can thus damage the visible outer surface of the upper of the footwear.

The various known footwear protectors have generally been designed to protect a relatively large portion of the upper of the footwear, and generally include relatively thick panels of material for protection and bands and buckles for securing the thick panels to the footwear. The resulting footwear protectors are bulky and difficult to place in the rider's pocket or purse, and thus can be inconvenient to carry around while the rider is not using the protector. The known protectors also tend to be of one particular size and shape, so that a specific size of protector is needed for a particular size or style of footwear, thus making interchangeability between different styles and sizes of footwear difficult if not impossible.

The footwear protector for motorcycle riding according to the present invention substantially departs from the conventional concepts and designs of the prior art, and in so doing provides an apparatus primarily developed for the purpose of protecting the footwear of motorcycle riders with an article that is easily mounted on the footwear.

SUMMARY OF THE INVENTION

In view of the foregoing disadvantages inherent in the known types of footwear protection devices now present in the prior art, the present invention provides a new footwear protector for motorcycle riding construction wherein the same can be utilized for protecting the footwear of motorcycle riders with an article that is easily mounted on the footwear.

The general purpose of the present invention, which will be described subsequently in greater detail, is to provide a new footwear protector for motorcycle riding apparatus and method which has many of the advantages of the footwear protection devices mentioned heretofore and many novel features that result in a new footwear protector for motorcycle riding which is not anticipated, rendered obvious, suggested, or even implied by any of the prior art footwear protection devices, either alone or in any combination thereof.

To attain this, the present invention generally comprises a footwear protective device for protecting footwear while riding a motorcycle having a foot-actuated gear shift actuator. The protective device includes a sheath member having a forward end and a rearward end, with the forward end being closed and the rearward end having an opening. The sheath member has a top wall and a bottom wall, with a pair of side walls and a front wall extending between the top and bottom walls. The device also includes a gear shift actuator cushion mounted on the top wall of the sheath member. The actuator cushion extends from the opening toward the forward end of the sheath member. A pocket is formed on the top wall of the sheath member. The actuator cushion comprises a resiliently compressible cushion in the pocket for cushioning the transmission of impacts from an upper surface of the actuator cushion to the top wall of the sheath member and footwear positioned in the sheath member. The side walls are preferably formed of a resiliently stretchable material, and the resiliently stretchable material may include spandex.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new footwear protector for motorcycle riding apparatus and method which has many of the advantages of the footwear protection devices mentioned heretofore and many novel features that result in a new footwear protector for motorcycle riding which is not anticipated, rendered obvious, suggested, or even implied by any of the prior art footwear protection devices, either alone or in any combination thereof.

It is another object of the present invention to provide a new footwear protector for motorcycle riding which may be easily and efficiently manufactured and marketed.

It is a further object of the present invention to provide a new footwear protector for motorcycle riding which is of a durable and reliable construction.

An even further object of the present invention is to provide a new footwear protector for motorcycle riding which is susceptible of a low cost of manufacture with regard to both materials and labor, and which accordingly is then susceptible of low prices of sale to the consuming public, thereby making such footwear protector for motorcycle riding economically available to the buying public.

Still yet another object of the present invention is to provide a new footwear protector for motorcycle riding which provides in the apparatuses and methods of the prior art some of the advantages thereof, while simultaneously overcoming some of the disadvantages normally associated therewith.

Still another object of the present invention is to provide a new footwear protector for motorcycle riding for protecting the footwear of motorcycle riders with an article that is easily mounted on the footwear.

Yet another object of the present invention is to provide a new footwear protector for motorcycle riding which includes a sheath member having a forward end and a rearward end, with the forward end being closed and the rearward end having an opening. The sheath member has a top wall and a bottom wall, with a pair of side walls and a front wall extending between the top and bottom walls. The device also includes a gear shift actuator cushion mounted on the top wall of the sheath member. The actuator cushion extends from the opening toward the forward end of the sheath member. A pocket is formed on the top wall of the sheath member. The actuator cushion comprises a resiliently compressible cushion in the pocket for cushioning the transmission of impacts from an upper surface of the actuator cushion to the top wall of the sheath member and footwear positioned in the sheath member. The side walls are preferably formed of a resiliently stretchable material, and the resiliently stretchable material may include spandex.

Still yet another object of the present invention is to provide a new footwear protector for motorcycle riding that is easily installed and removed from footwear and that collapses into a compact and substantially flat configuration that can be easily carried in a pocket or purse.

Even still another object of the present invention is to provide a new footwear protector for motorcycle riding that is easily adaptable to a variety of shoe sizes and styles without having to buy different sizes of shoe protectors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
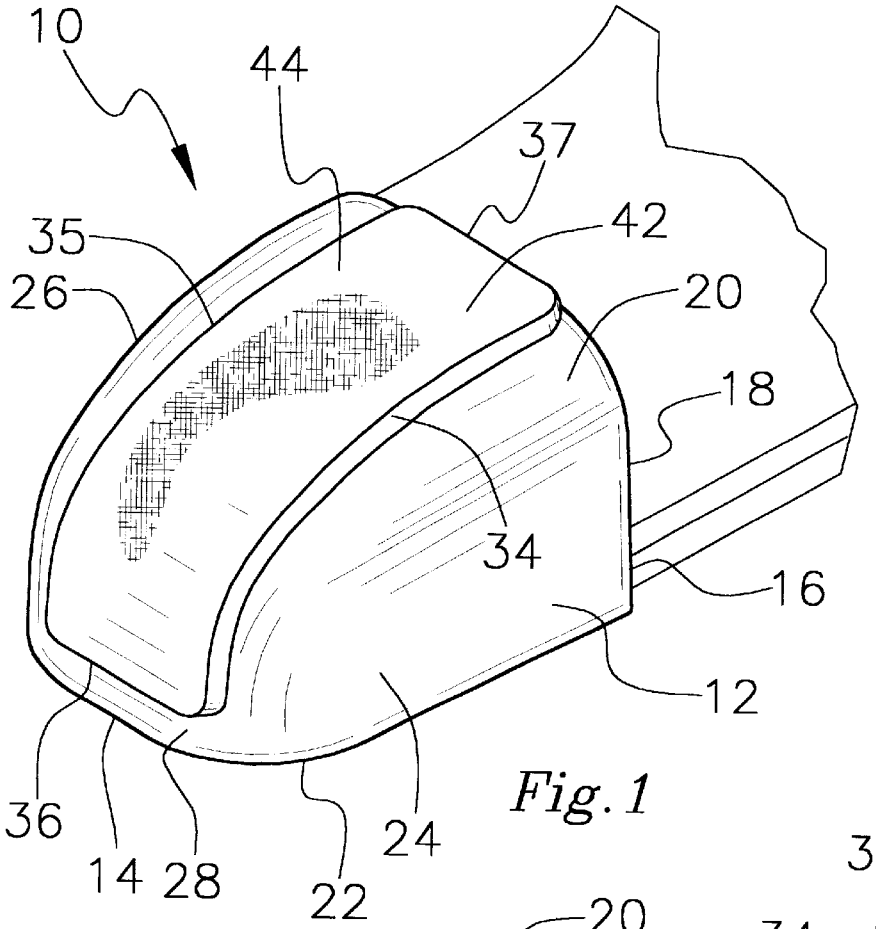
FIG. 1 is a schematic perspective view of a new footwear protector for motorcycle riding according to the present invention particularly illustrating the protector with respect to a portion of a shoe.
Figure 2:
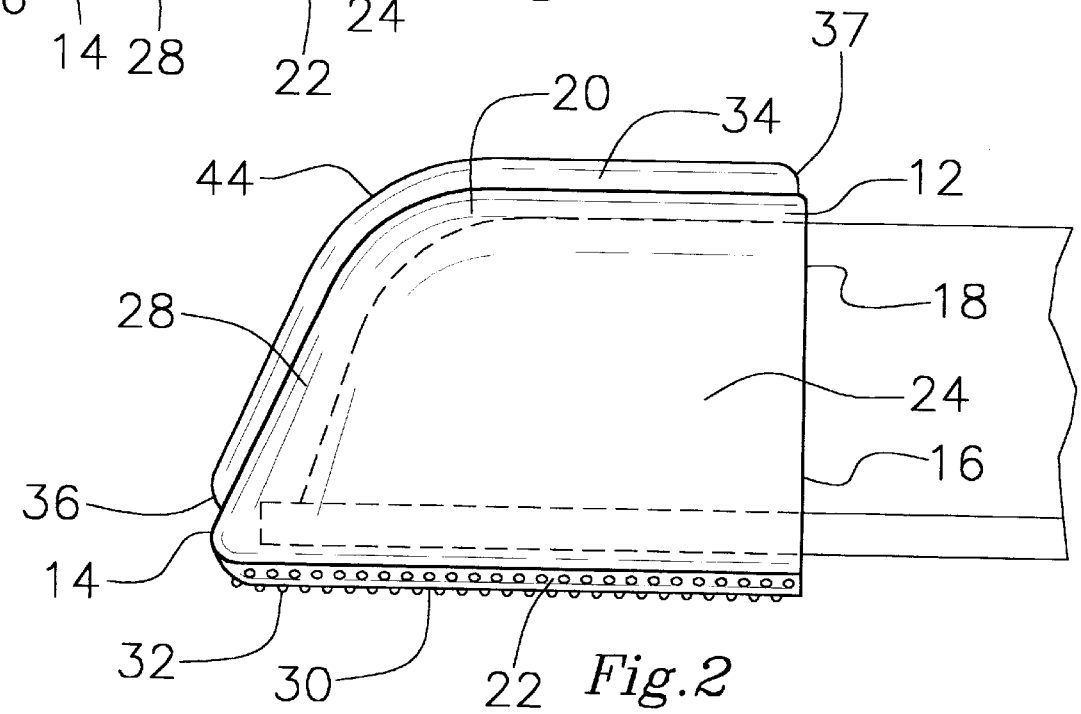
FIG. 2 is a schematic side view of the present invention mounted on a shoe.
Figure 3:
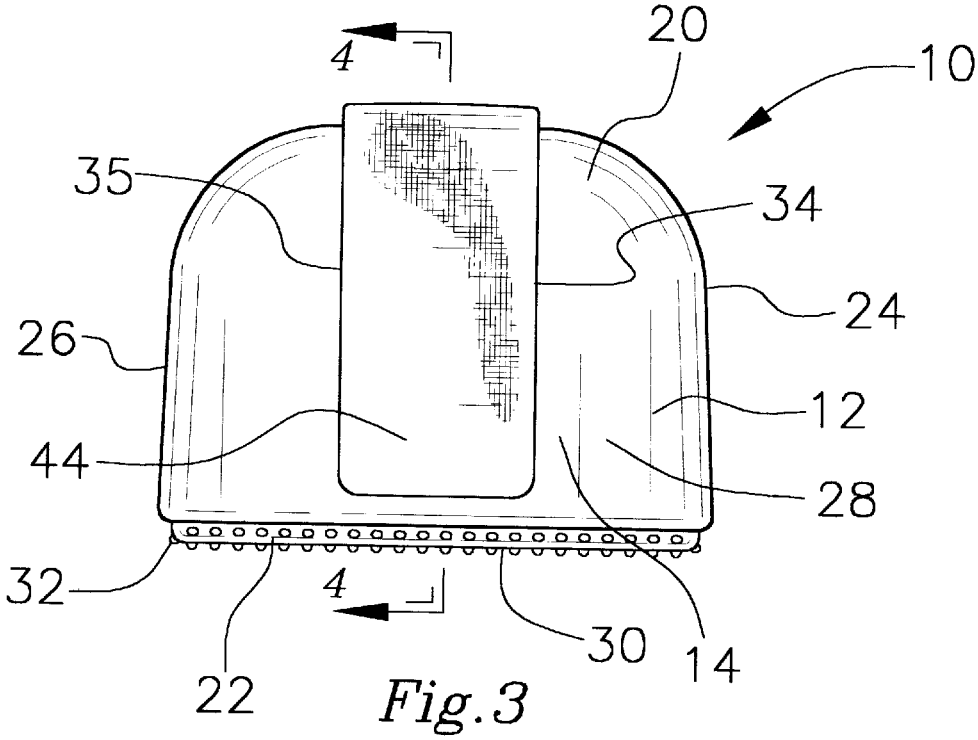
FIG. 3 is a schematic front end view of the present invention.
Figure 4:
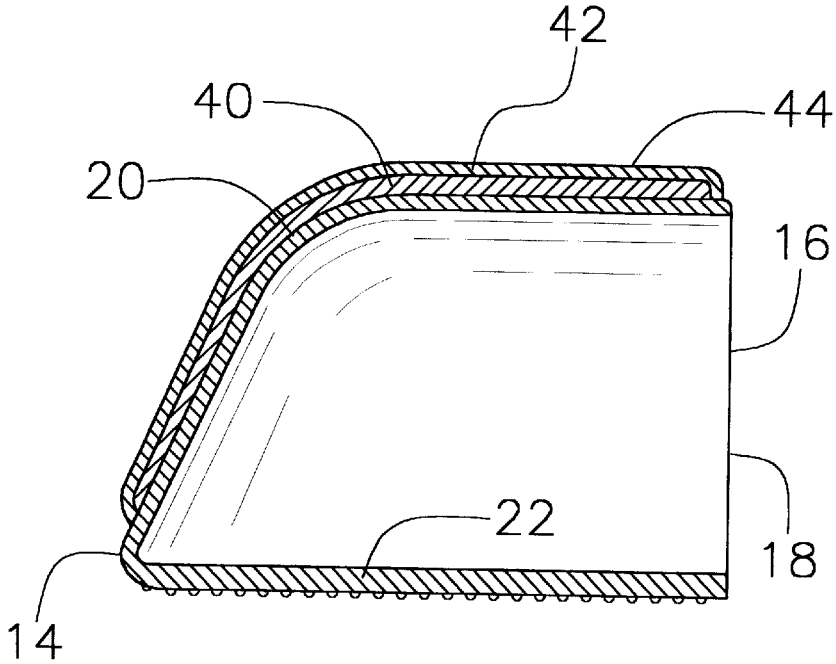
FIG. 4 is a schematic sectional view of the present invention taken along line 4—4 of FIG. 3.
Figure 5:
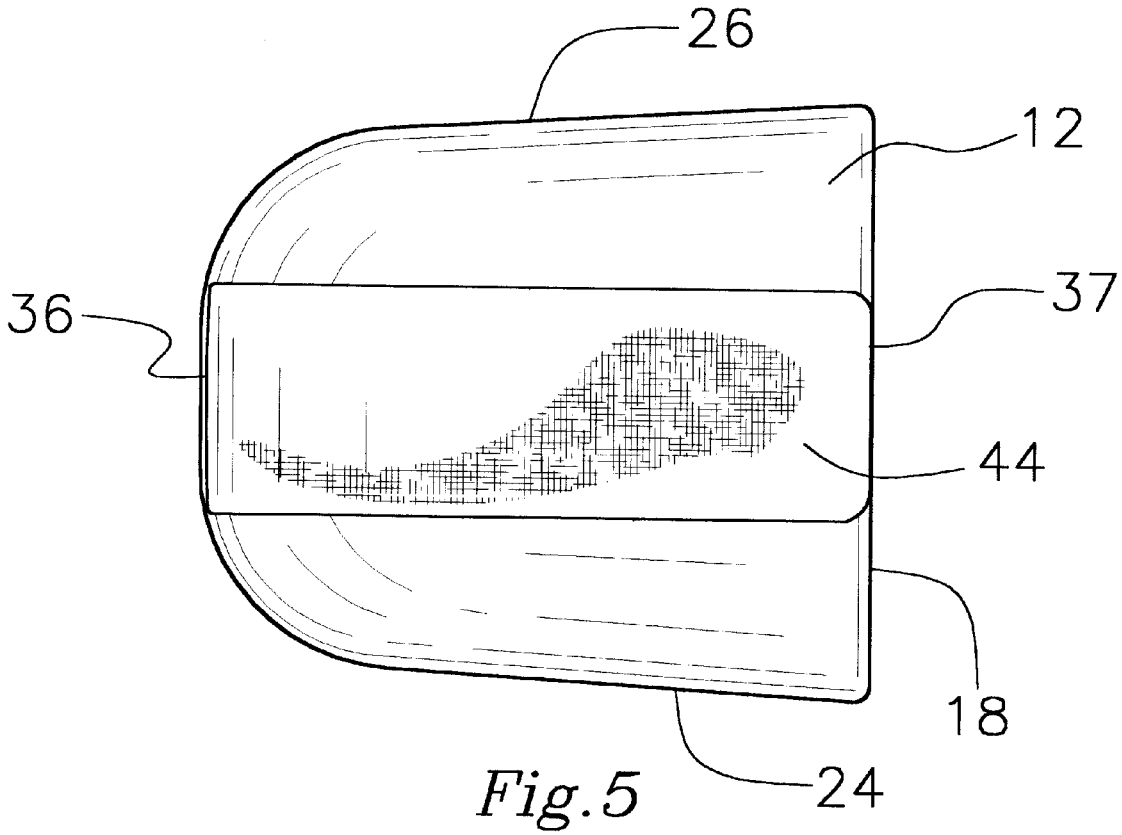
FIG. 5 is a schematic top view of the present invention.
Figure 6:
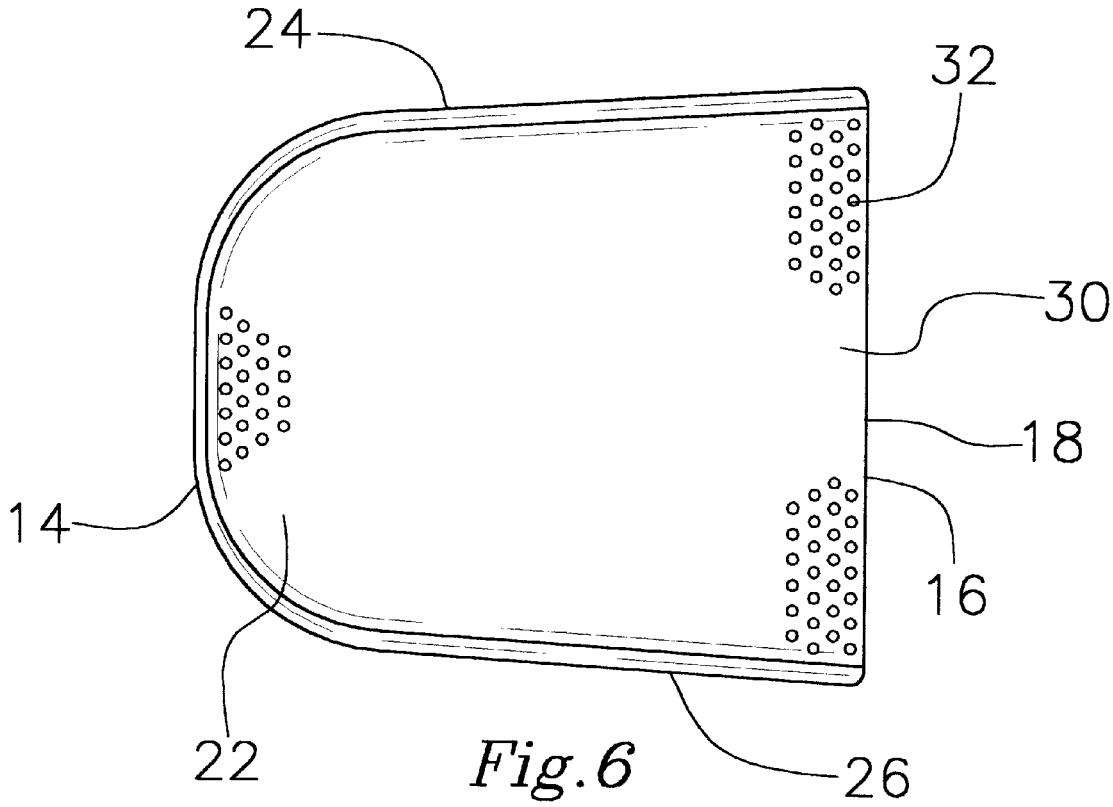
FIG. 6 is a schematic bottom view of the present invention.

With reference now to the drawings, and in particular to FIGS. 1 through 6 thereof, a new footwear protector for motorcycle riding embodying the principles and concepts of the present invention and generally designated by the reference numeral 10 will be described.

As best illustrated in FIGS. 1 through 6, the footwear protector for motorcycle riding 10 is highly suitable for use by those operating a motorcycle (or other apparatus) having a foot actuated gear shift actuator that requires the operator to move the actuator upward with the upper surface of the footwear. The typical footwear has an upper and a sole.

The invention comprises a sheath member 12 and a gear shift actuator cushion 40 mounted on the sheath member.

The sheath member 12 has a forward end 14 and a rearward end 16. The forward end is closed and the rearward end has an opening 18 for receiving the footwear therethrough. The sheath member has a top wall 20 and a bottom wall 22. A pair of side walls 24, 26 and a front wall 28 extend between the top and bottom walls. The bottom wall has an outer surface 30.

In a preferred embodiment of the invention, a plurality of spaced protuberances 32 are mounted on the outer surface 30. Each of the protuberances 32 may have a substantially hemispherical shape. The protuberances 32 may be substantially uniformly spaced from each other.

Significantly, the side walls 24, 26 of the sheath member are preferably formed of a resiliently stretchable material, which permits the perimeter of the opening 18 to be expanded to snugly fit the size of the footwear inserted in the opening, and also holds the top and bottom walls snugly against the footwear. In one embodiment of the invention, the top wall 20 and the side walls 24, 26 may be formed of a first continuous panel of material, and the bottom wall may be formed of a second continuous panel of material. The first continuous panel of material is formed of a resiliently stretchable material such that a perimeter of the opening is resiliently expandable in size, the resiliently stretchable material including spandex. Illustratively, the distance between the forward end 14 and the rearward end 16 is approximately 6 inches, which is preferred for achieving the most secure fit on the footwear.

The gear shift actuator cushion 40 is mounted on the top wall 20 of the sheath member 12. The actuator cushion 40 may extend from the opening 18 toward the forward end 14 of the sheath member. A pocket 42 is formed on the top wall 20 of the sheath member for holding the actuator cushion 40. The actuator cushion 40 preferably comprises a resiliently compressible cushion in the pocket 42 for cushioning the transmission of impacts from an upper surface 44 of the actuator cushion to the top wall of the sheath member and footwear positioned in the sheath member. The actuator cushion 40 has side boundaries 34, 35 and end boundaries 36, 37. The side boundaries 34, 35 may be oriented substantially parallel to each other.

In a highly preferred embodiment, the cushion is formed from a foamed plastic material that is resiliently compressible. The distance between the side boundaries 34, 35 is approximately 2 inches, and the distance between the end boundaries 36, 37 is approximately 4.5 inches. The thickness of the actuator cushion may be approximately ¼ inch. Optionally, the actuator cushion may comprises a relatively thick cotton panel, or a leather panel, although these materials do not provide as much cushioning as the preferred foamed material.

In use, the sheath member is unfolded from a flattened, stored condition and the front tip of the footwear is inserted into the opening of the sheath member and into the interior of the sheath member. The footwear expands the perimeter of the opening and various panels of the sheath member, and the sheath member is held on the footwear by the constriction of the sheath member on the footwear. After use, the sheath is slipped off of the footwear and the sheath member may be folded and placed in a pocket or purse of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A footwear protective device for protecting footwear while riding a motorcycle having a foot-actuated gear shift actuator, the footwear being of the type having an upper and a sole, the protective device comprising:

a sheath member having a forward end and a rearward end, the forward end being closed and the rearward end having an opening, the sheath member having a top wall, a bottom wall, and a pair of side walls and a front wall extending between the top and bottom walls;

a gear shift actuator cushion mounted on the top wall of the sheath member, the actuator cushion extending from the opening toward the forward end of the sheath member, wherein a pocket is formed on the top wall of the sheath member, the actuator cushion comprising a resiliently compressible cushion in the pocket for cushioning the transmission of impacts from an upper surface of the actuator cushion to the top wall of the sheath member and footwear positioned in the sheath member.

2. The device of claim 1 wherein the bottom wall of the sheath member has an outer surface with a plurality of spaced protuberances.

3. The device of claim 2 wherein each of the protuberances has a substantially hemispherical shape.

4. The device of claim 2 wherein the protuberances are substantially uniformly spaced from each other.

5. The device of claim 1 wherein the side walls are formed of a resiliently stretchable material.

6. The device of claim 5 wherein the resiliently stretchable material includes spandex.

7. The device of claim 1 wherein the top wall and the side walls are formed of a first continuous panel of material, and the bottom wall is formed of a second continuous panel of material.

8. The device of claim 7 wherein the first continuous panel of material is formed of a resiliently stretchable material such that a perimeter of the opening is resiliently expandable in size.

9. The device of claim 8 wherein the resiliently stretchable material includes spandex.

10. The device of claim 1 wherein the distance between the forward end and the rearward end is approximately 6 inches.

11. The device of claim 1 wherein the actuator cushion has side boundaries and end boundaries, the side boundaries being substantially parallel to each other.

12. The device of claim 11 wherein a distance between the side boundaries is approximately 2 inches, a distance between the end boundaries is approximately 4.5 inches, and a thickness of the actuator cushion is approximately ¼ inch.

13. A footwear protective device for protecting footwear while riding a motorcycle having a foot-actuated gear shift actuator, the footwear being of the type having an upper and a sole, the protective device comprising:

a sheath member having a forward end and a rearward end, the forward end being closed and the rearward end having an opening, the sheath member having a top wall, a bottom wall, and a pair of side walls and a front wall extending between the top and bottom walls, the bottom wall having an outer surface with a plurality of spaced protuberances, each of the protuberances having a substantially hemispherical shape, the protuberances being substantially uniformly spaced from each other, the side walls being formed of a resiliently stretchable material, the top wall and the side walls being formed of a first continuous panel of material, the bottom wall being formed of a second continuous panel of material, the first continuous panel of material being formed of a resiliently stretchable material such that a perimeter of the opening is resiliently expandable in size, the resiliently stretchable material including spandex;

a gear shift actuator cushion mounted on the top wall of the sheath member, the actuator cushion extending from the opening toward the forward end of the sheath member, wherein a pocket is formed on the top wall of the sheath member, the actuator cushion comprising a resiliently compressible cushion in the pocket for cushioning the transmission of impacts from an upper surface of the actuator cushion to the top wall of the sheath member and footwear positioned in the sheath member, the actuator cushion having side boundaries and end boundaries, the side boundaries being substantially parallel to each other.

14. The device of claim 13 wherein a distance between the side boundaries is approximately 2 inches, a distance between the end boundaries is approximately 4.5 inches, and a thickness of the actuator cushion is approximately ¼ inch, wherein the distance between the forward end and the rearward end is approximately 6 inches.

* * * * *